US005876190A

United States Patent [19]

Spring

[11] Patent Number: 5,876,190

[45] Date of Patent: Mar. 2, 1999

[54] VACUUM MEMBRANE PUMP AND A HEAD PORTION FOR A VACUUM MEMBRANE PUMP

[75] Inventor: Arthur Spring, Flawil, Switzerland

[73] Assignee: Buchi Labortechnik AG, Flawil, Switzerland

[21] Appl. No.: 759,460

[22] Filed: Dec. 5, 1996

[30] Foreign Application Priority Data

Jan. 3, 1996 [CH] Switzerland ..... 00006/96

[51] Int. Cl.[6] ..... F04B 17/00

[52] U.S. Cl. ..... 417/413.1; 417/454; 417/DIG. 1; 92/164

[58] Field of Search ..... 417/413.1, 571, 417/DIG. 1, 454; 92/164

[56] References Cited

U.S. PATENT DOCUMENTS

| | | | |
|---|---|---|---|
| 2,859,912 | 11/1958 | Swart et al. | 417/571 |
| 3,947,156 | 3/1976 | Becker | 417/413.1 |
| 4,516,479 | 5/1985 | Vadasz | 417/DIG. 1 |
| 5,002,471 | 3/1991 | Perlov | 417/413.1 |
| 5,033,940 | 7/1991 | Baumann | 417/DIG. 1 |
| 5,171,132 | 12/1992 | Miyazaki et al. | 417/413.1 |
| 5,219,278 | 6/1993 | Van Lintel | 417/413 |
| 5,275,541 | 1/1994 | Becker et al. | 417/571 |
| 5,540,568 | 7/1996 | Rosen et al. | 417/454 |
| 5,676,531 | 10/1997 | Muscarella et al. | 417/413.1 |

*Primary Examiner*—Charles G. Freay
*Attorney, Agent, or Firm*—Shoemaker and Mattare, Ltd

[57] ABSTRACT

A vacuum membrane pump includes a housing, a membrane and a head portion having a sealing surface which engages with a sealing edge of the membrane to form a seal. A pump chamber is formed between the head portion and the membrane. The head portion is cast from glass, and has at least one penetrating opening for accommodating a valve element on the side away from the pump chamber. The membrane rests with its sealing edge on a shoulder of the housing and, with the sealing edge, engages with the sealing surface of the head. The valve element is in turn engaged with the inside of the openings of the head. A closure connected to the housing delivers an axial force to the valve element. The valve element, the head, and the membrane are pressed together to form a sealed assembly.

13 Claims, 3 Drawing Sheets

VACUUM MEMBRANE PUMP AND A HEAD PORTION FOR A VACUUM MEMBRANE PUMP

BACKGROUND OF THE INVENTION

The invention concerns a vacuum membrane pump, respectively a head portion for a vacuum membrane pump, according to the preamble to the independent patent claims.

Membrane pumps with an elastic membrane engaging with a counterpart to form a seal, and with a pump chamber being defined between counterpart and membrane, are state of the art. In general, an inlet and an outlet valve open into the pump chamber. The membrane is moved by means of a cam in such a way that the volume of said chamber is periodically reduced and enlarged. On enlargement of the volume, air is drawn in via the inlet valve, said air being expelled via the outlet or exhaust valve on reduction of said volume. In this way, pressurization and a partial vacuum can be imparted to gaseous media.

Mainly when using membrane pumps for the creation of a vacuum, great demands are placed on the materials of the components used. In particular, solvents contained in a gas shall not be permitted to accumulate on the surface of the membrane and/or the counterpart. The membrane must be both flexible and gastight while, at minimum volume, the counterpart should have a complementary form that exactly corresponds to the form of the membrane. In order to create the greatest possible efficiency, the volume of the pump chamber should assume the smallest possible value on completion of the expulsion sequence.

Membrane pumps are, for example, disclosed in DE 40 07 932 A1, DE 28 51 060 A1 and EP 072 275 A1. DE 40 07 932 discloses a membrane pump with a reinforced shaped membrane at its centre; DE 28 51 060 shows a membrane pump possessing two pump chambers separated by a single membrane; and EP 072 275 shows a vacuum pump with a special distribution arrangement for the inlet and outlet valves.

All such state-of-the-art membrane pumps possess various drawbacks, however. In particular, the membrane and the counterpart must be subjected to surface treatment which results in complex and expensive manufacture. Plastic materials used for the counterpart are not necessarily form-stable, and without surface treatment will frequently absorb solvents which can be released again when a vacuum is created.

A further drawback of state-of-the-art pumps is their complicated construction. The individual parts must be connected together to form a seal, and until now this has required the use of many separate components such as seals, screws and clamps.

SUMMARY OF THE INVENTION

The purpose of this invention is to avoid the disadvantages of state of the art, and thus in particular to create a vacuum membrane pump that, while requiring few components, is simple and economical to manufacture, and is distinguished by high efficiency of operation.

This purpose is fulfilled with a vacuum membrane pump or with a head portion for a vacuum membrane pump according to the characterizing portion of the independent patent claims.

A vacuum membrane pump essentially comprises a housing, a membrane, a pump chamber and a head portion. The pump chamber is bordered on one side by the head portion, and on the other side by the membrane. The head portion engages with the membrane to form a seal. The head portion is cast from glass, said casting possessing a sealing surface for the formation of a sealing engagement with the membrane and, in order to accommodate a valve element, possessing at least one opening on its side oriented away from the pump chamber, said opening passing through the head portion. The pump chamber must, notwithstanding the valve element (said valve element possessing an inlet and an outlet valve), be sealed to be fully gastight from the environment. The advantage of a head portion cast in glass is that glass on the one hand possess good chemical properties with regard to interfering substances such as solvents, and on the other hand is distinguished by good mechanical properties such as form-stability.

A vacuum membrane pump can be manufactured in a particularly simple way if the housing possess a circumferential shoulder with a protrusion on which the membrane, with its sealing edge area, can be placed. The head portion possesses a sealing surface, said sealing surface engaging to form a seal with the sealing edge of the membrane. The separate components of the pump can be held together in a simple way by a closure arrangement that connects the head portion with the housing and thus clamps the membrane between said housing and said head portion.

The closure arrangement will be particularly advantageous if it takes effect not directly on the head portion but on the valve element, said valve element being inserted in an opening on the side of the head portion oriented away from the pump chamber. The closure arrangement exerts a force on the valve element, said valve element being pressed against the head portion, thus clamping the membrane between housing and head portion.

It is particularly favourable if the opening passing through the head portion tapers towards the pump chamber and if the valve element to be inserted into said opening likewise possesses a portion with a downward taper. The valve element with the tapering portion can be inserted into the opening, by which means a connection will result that will form a good seal. A further advantage will arise if the valve element is integrally formed. Naturally, the opening and the sealing portion can also be cylindrically shaped so that a sealing effect between two cylindrical surfaces will result.

In a preferred embodiment, the head portion possesses two openings wherein the inlet valve can be inserted into one opening, and the outlet valve can be inserted into the other.

In a further preferred embodiment, the sealing surface of the head portion lies on one plane, and the surface of the head portion defining the pump chamber is formed by a vaulted ball-shaped section.

The invention is more closely explained in the following, on the basis of the drawings and embodiments: namely, FIG. 1 a cross section through the upper portion of a pump according to the present invention, FIG. 2 head portion of a pump according to FIG. 1 with valve elements not yet fitted, FIG. 3 plan view of the head portion from FIG. 2, FIG. 4 view from below of the head portion from FIG. 2, and FIG. 5 a schematic representation of an upper portion of a pump with a closure arrangement.

DESCRIPTION OF PREFERRED EMBODIMENT

Figure 1:
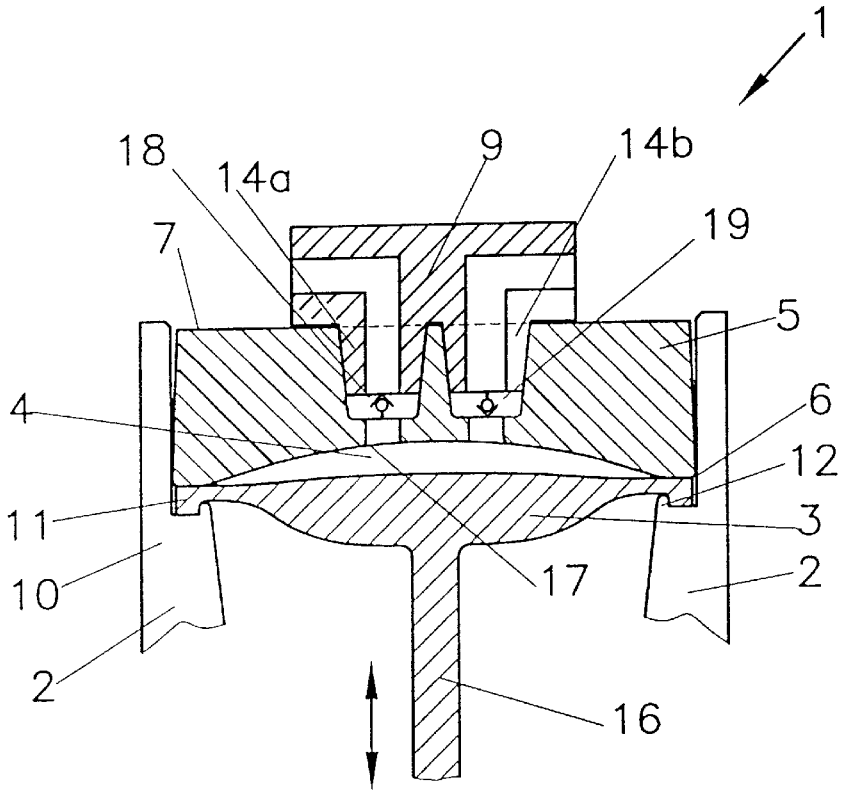

A vacuum membrane pump 1 essentially comprises a housing 2, a flexible membrane 3 and a head portion 5. The membrane 3 with an edge area 11 engages to form a seal with a circumferential sealing surface 6. In this way, the pump chamber is enclosed between the surface of the membrane 3 and the glass portion 5. The membrane is pressed and clamped fast on a circumferential shoulder 10 of the housing 2 by means of the head portion. To increase the clamping effect, the shoulder 10 can possess a circumferential protrusion 12. The membrane is connected via an arm 16 to a cam and a motor (not shown). Accordingly, an upward and downward movement (FIG. 1) can be imparted to the membrane, by which means the volume of the pump chamber 4 is periodically reduced and enlarged.

The head portion 5 is cast from glass and possesses two openings on the side 7 oriented away from the pump chamber 4, said openings passing through the entire head portion. Preferably, the inside surface 17 bordering the pump chamber 4 is curved, for example in the form of a ball section, so that in its uppermost position the membrane 3 is optimally adapted to the inside surface 17 of the head portion 5. In this way, greater efficiency is attained and the unswept or dead volume of the pump is kept to a minimum.

A valve element 9 is inserted into both the openings 8 in the head portion 5. The valve element 9 possesses two parts 14*a* and 14*b*, said parts being inserted in the openings 8. Two sealing discs 15*a* and 15*b* are placed between parts 14*a* and 14*b* and a narrowing of the opening 8 in such a way that two non-return valves will result. An inlet valve 18 and an outlet valve 19 are formed in this way. If the volume of the pump chamber 4 is enlarged by downward movement of the elastic membrane, the inlet valve 18 will open, with the outlet valve 19 at the same time closing. If, in a following step, the pump chamber 4 is reduced by an upwards movement of the membrane 3, the inlet valve 18 is closed and the gas contained in the pump chamber 4 is expelled through the outlet valve 19. By repeating these steps, a vacuum is created in the vessel connected to the inlet valve 18.

Figure 2:
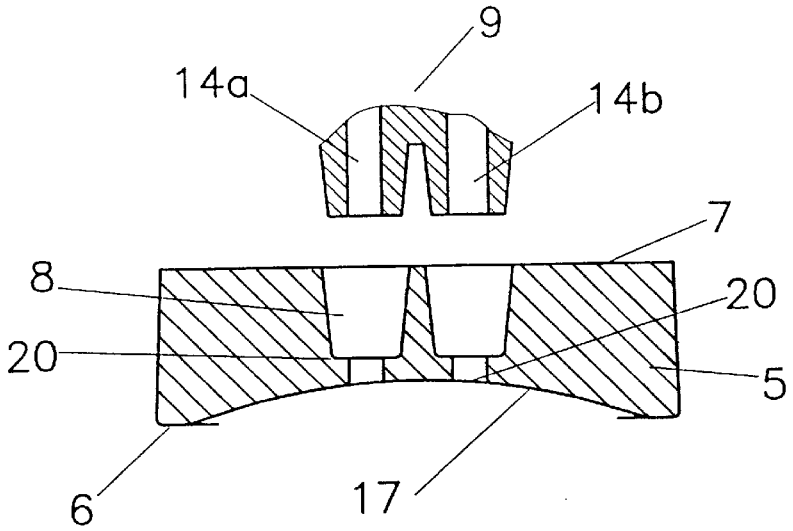

In FIG. 2, the head portion 5 and the valve element 9 are shown without the membrane and the housing. The openings 8 of the head portion 5 taper towards the pump chamber and at their lower end possess a circumferential step 20. The opening allocated to accommodate the outlet valve 19 can in addition possess a circumferential rib on the step 20 in order to raise the sealing effect. Both the parts 14*a* and 14*b* of the valve element 9 also taper downwards and possess such dimensions that they form a precise fit in the openings 8 of the head portion 5. The part forming the inlet valve is in addition provided with a circumferential protrusion on its lower edge to raise the sealing effect. A sealing disc 15 is in each case inserted between the circumferential step 20 of the opening 8 and the lower edge of parts 14*a* and 14*b*. The dimension of the parts 14*a* and 14*b* is chosen in such a way that the sealing discs are not clamped between the steps and the lower edge of the parts, but are able to move freely over a specific distance. When the pump chamber 4 enlarges, the sealing disc 15*a* does not lie on the step 20 to form a seal, while the sealing disc 15*b* is pressed to form a seal on the circumferential protrusion of the step 20. On reduction of the pump chamber 4, the sealing disc 15*a* is pressed to form a seal against the circumferential protrusion of the part 14*a*, while the sealing disc 15*b* does not engage to form a seal with the lower edge of the part 14*b*.

To increase its mechanical strength, the membrane 3 is reinforced with a fixed core (not shown) and/or possesses ribs that ensure better connection between the arm 16 and the actual membrane 3. The membrane 3 possesses good elastic properties and, for improvement of its chemical properties, is coated or subjected to surface treatment.

Figure 3:
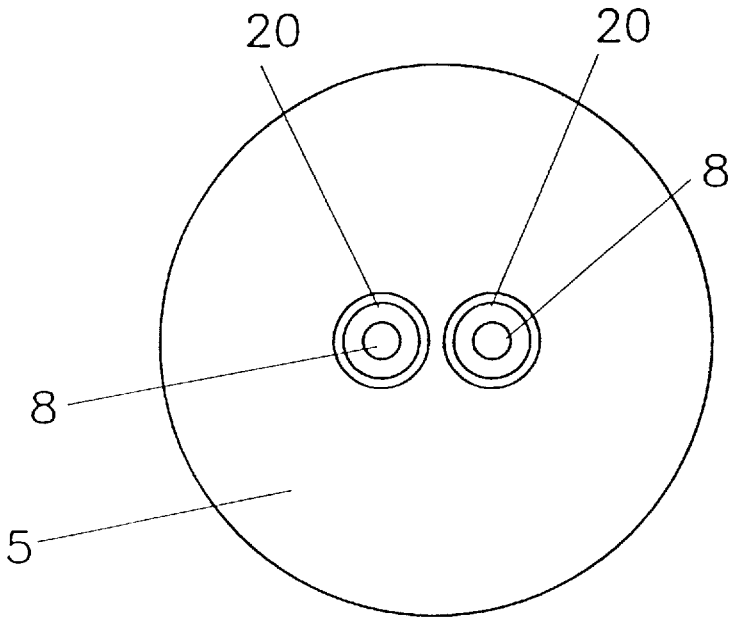

FIG. 3 shows a plan view of the head portion 5. Both the openings 8 pass through the head portion, taper downwards and possess at their lower edge a circumferential step 20. The overall geometry of the pump is preferably chosen to be circular, which is particularly favourable when the mechanical loading of the membrane is considered.

Figure 4:
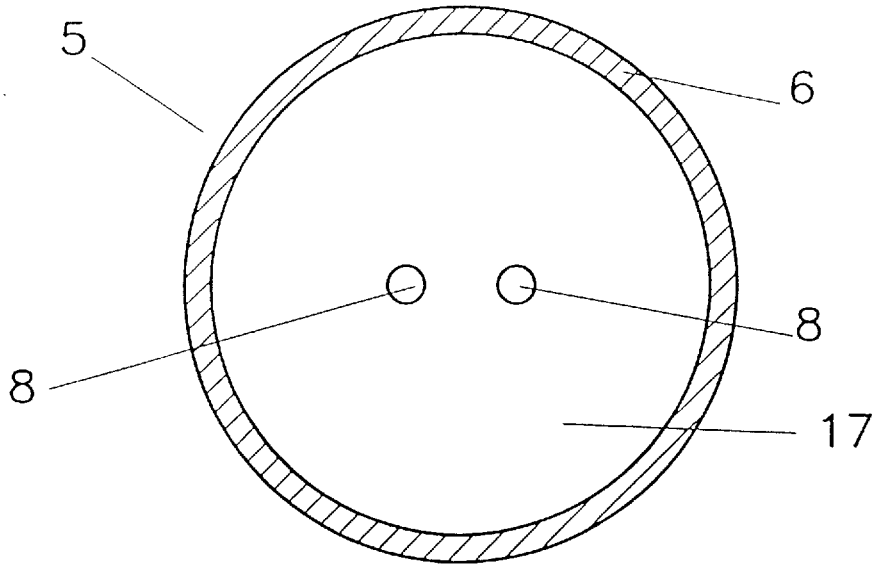

FIG. 4 shows a view of a head portion 5 from below. The inside surface 17 oriented toward the pump chamber 4 is vaulted, and the head portion 5 possesses a circumferential sealing surface 6 at its edge.

Figure 5:
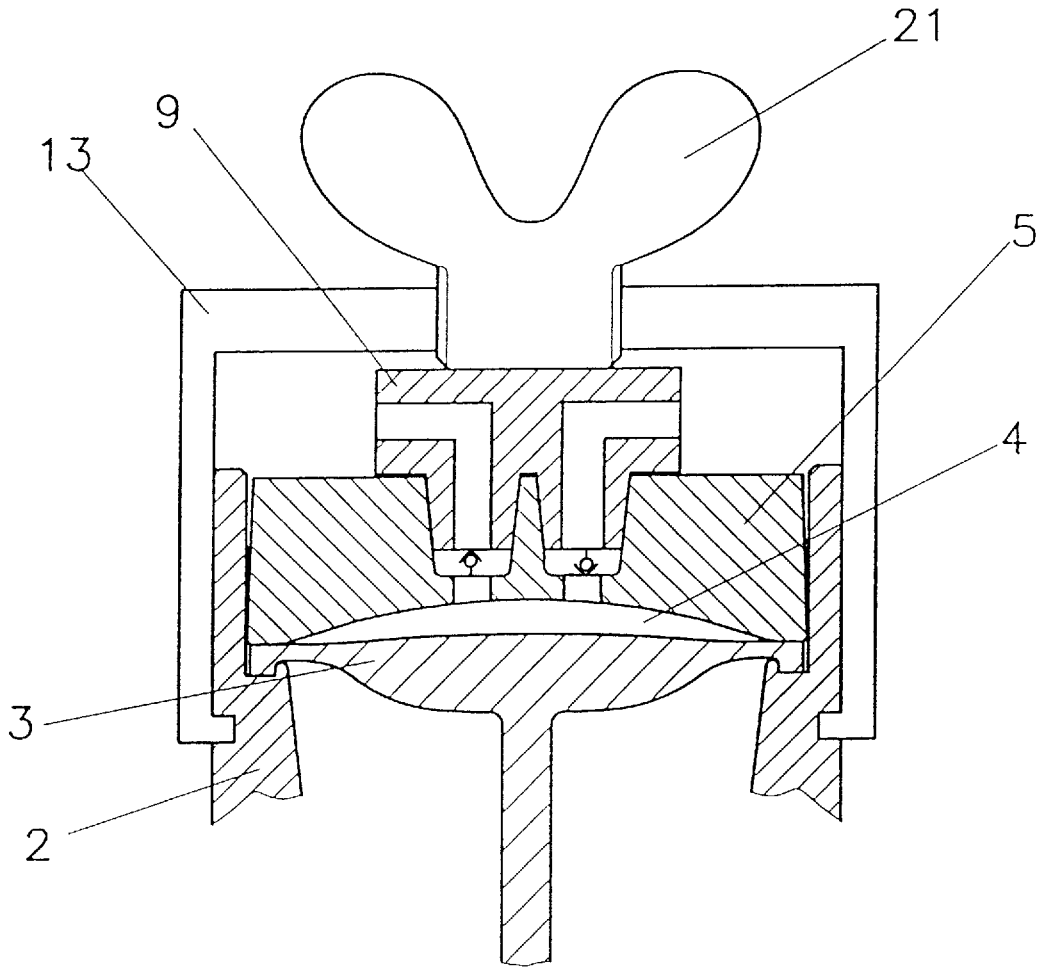

The pump shown in FIG. 1 essentially comprises four parts, said parts being joined together to form a seal. To create the pressing force required to form the seal, a closure arrangement 13 is used which on the one hand is connected with the housing 2 and on the other hand is constructed so as to exert a force on the valve element 9. FIG. 5 schematically shows an upper portion of a membrane pump with a housing 2, a membrane 3, a head portion 5, a valve element 9 and a pump chamber 4. The closure arrangement 13 is firmly connected to the housing 2 and possesses means 21 to exert an axial force onto the valve element 9. The overall pump arrangement is in this way pressed together, for example by means of a screw. The advantages arising during manufacture and cleaning are here obvious.

Inasmuch as the invention is subject to modifications and variations, the foregoing description and accompanying drawings should not be regarded as limiting the invention, which is defined by the following claims and various combinations thereof:

What is claimed is:

1. Head portion for a vacuum membrane pump (1) with a pump housing (2), a membrane (3), a pump chamber (4) and a head portion (5), characterized in that the head portion (5) is cast from glass, said head portion bordering the pump housing (2) on one side and possessing a sealing surface (6) for the formation of a sealing engagement with the membrane (3) and, on a side (7) oriented away from the pump chamber (4), possessing at least one opening (8) for accommodation of a valve element (9), said opening (8) passing through said head portion (5).

2. Head portion according to claim 1, characterized in that the openings (8) taper towards the pump chamber (4).

3. Head portion according to claim 1, characterized in that said head portion (5) possesses two openings (8).

4. Head portion according to claim 1, characterized in that the valve element (9) is integrally formed and possesses two parts (14*a*, 14*b*) which taper downwards.

5. Head portion according to claim 1, characterized in that the sealing surface (6) lies on one plane.

6. Head portion according to claim 1, characterized in that the head portion has a vaulted inside surface oriented towards the pump chamber (4).

7. Vacuum membrane pump (1) with a housing (2), a head portion (5), a membrane (3) arranged between the housing (2) and the head portion (5), and a pump chamber (4), said pump chamber (4) being bordered on one side by the head portion (5) and on the other side by the membrane (3), characterized in that the head portion (5) is cast from glass, said head portion (5) possessing a sealing surface (6) for the formation of a sealing engagement with the membrane (3) and possessing on a side (7) oriented away from the pump chamber (4) at least one opening (8) for accommodation of a valve element (9), said opening (8) passing through said head portion (5).

8. Pump according to claim 7, characterized in that the head portion has a vaulted inside surface (17) oriented towards the pump chamber (4).

9. A vacuum membrane pump comprising:

a housing having a circumferential shoulder with an annular protrusion, a head portion with at least one opening formed therein, a membrane arranged between said housing and said head portion and having a sealing edge for forming a seal with said protrusion, a pump chamber being bordered on one side by said head portion and on the other side by said membrane, a valve element inserted into said at least one opening, and a closure arrangement, wherein said closure arrangement is in coordinated arrangement with said valve element for pressing said valve element sealingly into said at least one opening, thereby pressing said head portion with a sealing surface against said sealing edge of said membrane and thereby pressing said sealing edge of said membrane against a shoulder of said housing.

10. Pump according to one of the claims 7 or 9, characterized in that the openings (8) taper towards the pump chamber (4).

11. Pump according to one of the claims 7 or 9, characterized in that the head portion (5) possesses two openings (8).

12. Pump according to one of the claims 7 or 9, characterized in that the valve element (9) is integrally formed and possesses two parts **(14*a*, 14*b*)** which taper downwards.

13. Pump according to one of the claims 7 or 9, characterized in that the sealing surface (6) lies on one plane.

* * * * *